US011148189B2

(12) United States Patent
Legat et al.

(10) Patent No.: US 11,148,189 B2
(45) Date of Patent: Oct. 19, 2021

(54) FORGED PISTON WITH ORIENTED GRAIN FLOW

(71) Applicant: Race Winning Brands, Inc., Mentor, OH (US)

(72) Inventors: Steven Edward Legat, Eastlake, OH (US); Cody Lyle Mayer, Chicago, IL (US); Brian Todd Reese, Cleveland Heights, OH (US)

( * ) Notice: Subject to any disclaimer, the term of this patent is extended or adjusted under 35 U.S.C. 154(b) by 0 days.

(21) Appl. No.: 16/594,741

(22) Filed: Oct. 7, 2019

(65) Prior Publication Data

US 2020/0116101 A1 Apr. 16, 2020

Related U.S. Application Data

(60) Provisional application No. 62/749,568, filed on Oct. 23, 2018, provisional application No. 62/743,752, filed on Oct. 10, 2018.

(51) Int. Cl.
*F02F 3/00* (2006.01)
*B21K 1/18* (2006.01)

(52) U.S. Cl.
CPC ..... *B21K 1/18* (2013.01); *F02F 3/0015* (2013.01); *F02F 3/0069* (2013.01); *F02F 2200/04* (2013.01)

(58) Field of Classification Search
CPC ..... F02F 3/00; F02F 3/0076; F02F 2200/04; F02F 2003/0007; F16J 1/00; F16J 1/001; B21J 1/025; B21K 1/18
See application file for complete search history.

(56) References Cited

U.S. PATENT DOCUMENTS 2,465,792 A * 3/1949 Davis ..... B21K 1/18 92/208
2,795,467 A * 6/1957 Colwell ..... C22C 21/02 92/222
3,010,186 A * 11/1961 Townhill ..... B21J 5/12 148/690
3,070,414 A * 12/1962 Wilcoxon ..... F16J 1/001 92/222
3,237,532 A * 3/1966 Clark ..... B21K 1/18 92/222
3,654,840 A * 4/1972 Elliott ..... B21K 1/18 92/222

(Continued)

FOREIGN PATENT DOCUMENTS

GB 1312610 A * 4/1973 ..... F16J 1/001

*Primary Examiner* — Grant Moubry
(74) *Attorney, Agent, or Firm* — Brennan, Manna & Diamond, LLC

(57) ABSTRACT

An improved piston forging for use in an internal combustion engine is disclosed. The piston forging comprises a crown, a pair of pin towers extending generally axially away from the crown, and a skirt extending generally axially away from the crown. The improved piston forging further comprises a plurality of grains flowing across the piston forging. The plurality of grains are reoriented during the forging operation into a configuration that follows the surfaces and features of the piston forging. More specifically, the plurality of grains are reoriented in a manner that is most beneficial to resist combustion and inertial forces that are enacted upon a machined piston during operation.

18 Claims, 3 Drawing Sheets

(56) References Cited

U.S. PATENT DOCUMENTS

| | | | | |
|---|---|---|---|---|
| 6,112,642 | A * | 9/2000 | Jarrett | F02F 3/0015 92/186 |
| 6,155,157 | A * | 12/2000 | Jarrett | F02F 3/003 92/186 |
| 7,870,669 | B2 * | 1/2011 | Ribeiro | B23P 15/10 29/888.05 |
| 8,312,856 | B2 * | 11/2012 | Yamagata | B21K 1/18 123/193.6 |
| 8,689,743 | B2 * | 4/2014 | Scharp | F02F 3/22 123/41.39 |
| 8,899,194 | B2 * | 12/2014 | Engel | F02B 25/18 123/73 PP |
| 8,899,208 | B2 * | 12/2014 | Bischofberger | F02F 3/18 123/193.6 |
| 9,739,234 | B2 * | 8/2017 | Schneider | F02F 3/285 |
| 10,422,299 | B2 * | 9/2019 | Weinenger | F02F 3/28 |
| 2017/0260927 | A1 * | 9/2017 | Weinenger | F02B 23/0672 |

* cited by examiner

FORGED PISTON WITH ORIENTED GRAIN FLOW

CROSS-REFERENCE

This application claims priority from U.S. Provisional Patent Application Ser. No. 62/743,752 filed on Oct. 10, 2019, and U.S. Provisional Patent Application Ser. No. 62/749,568 filed on Oct. 23, 2019, each of which is incorporated herein by reference.

BACKGROUND

Pistons that are used in internal combustion engines are typically manufactured by using either casting or forging manufacturing techniques. By way of background and generally stated, casting typically involves pouring liquid metal into a mold to form an object, such as a piston. By comparison, forging is the controlled deformation of metal into a specific shape by compressive force, a process that evolved from blacksmithing. The major differences between the two manufacturing techniques include strength, structural integrity, and resistance to impact and fatigue.

More specifically, the act of forging involves changing the internal grain structure of the metal, aligning it to the direction of force being applied, and making it stronger, more ductile, and giving it higher resistance to impact and fatigue. While a cast metal part will have a homogeneous, random grain structure, forging can intentionally direct that structure in ways that give a finished part the highest structural integrity of any metalworking process. Correct grain flow also allows for the near absence of structural defects or voids common in the casting process. When metal is forged, the molecular structure of the alloy is forced to directionally align, giving the part more consistent strength qualities. In the casting process, the alloy molecules are free to settle where they please, creating a random grain structure, and opening up the potential for weak spots.

While cast pistons are typically lighter in weight and relatively cheaper to manufacture, forged pistons tend to be stronger and more durable for the reasons stated above. Additionally, forged pistons are also preferred for higher performance applications, and are more customizable than cast pistons. More specifically, the forging process tends to produce a denser compression of molecules thereby resulting in a denser piston surface area and a piston that is more tolerant of the high temperatures, detonation forces, and higher pressures inherent in higher performance engines.

Pistons used in internal combustion engines are also subjected to high levels of stress during operation. Accordingly, pistons are designed to have sufficient stiffness and resistance to loads. However, it is also desirable to minimize the weight of the piston (which, in turn, improves inertial response of the piston), and to reduce piston surface area, particularly on the radially outer surfaces (which, in turn, reduces dynamic friction between the piston and the cylinder walls), and to account for various other design considerations and user preferences.

Consequently, there is a long felt need in the art for an improved piston that is capable of withstanding high levels of stress, and that exhibits sufficient stiffness and resistance to loads. There is also a long felt need in the art for an improved piston with reduced piston surface area to reduce frictional forces, and that is relatively light weight to improve the inertial response of the piston during operation.

The present invention discloses an improved forged piston for use in internal combustion engines that is designed to have improved resistance to loading, particularly loads resulting from internal combustion and inertia. Because of its enhanced performance characteristics, the improved forged piston of the present invention also possesses relatively low weight and a reduced surface area to further provide improved performance. More specifically, the improved forged piston of the present invention possesses a re-orientated and improved grain structure that is most beneficial to the resistance of combustion and inertial forces that are enacted upon a piston during its operation in an internal combustion engine, thereby permitting the use of a lighter piston with reduced surface area without sacrificing overall performance.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an improved forged piston for use in an internal combustion engine. The improved piston forging comprises a crown and a pair of pin towers extending axially away from the crown. The piston forging further comprises a skirt comprising skirt band and a pair of opposed skirt panel portions located on opposing sides of the piston forging along the skirt band. The piston forging further comprises a plurality of grains oriented across the piston forging to resist forces applied to the piston forging when in operation in an internal combustion engine.

The piston forging of the present invention may further comprise a plurality of skirt panel strut assemblies extending radially between the opposed skirt panel portions and the pin towers, and each of the plurality of skirt panel strut assemblies may comprise a pair of skirt panel struts that converge in a radially outward direction. Additionally, the piston forging may further comprise a plurality of supplemental strut assemblies extending radially between the skirt band and the pin towers, wherein each of the plurality of supplemental strut assemblies may further comprise a pair of supplemental struts that may diverge in a radially outward direction.

As an important aspect of the present invention, the plurality of grains are configured/orientated to flow from one side of the piston forging to the opposing side along an axis running between the pair of pin towers. More specifically, the plurality of grains are re-oriented during the forging process and generally flow downward through one of the pair of pin towers, across an underside of the crown, and back up the opposing pin tower. The plurality of grains then flow along each of the pair of supplemental struts concentrated on an external surface of each of the supplemental struts, and may penetrate up to an entire thickness and length of each supplemental strut.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION OF THE INVENTION

Figure 1:
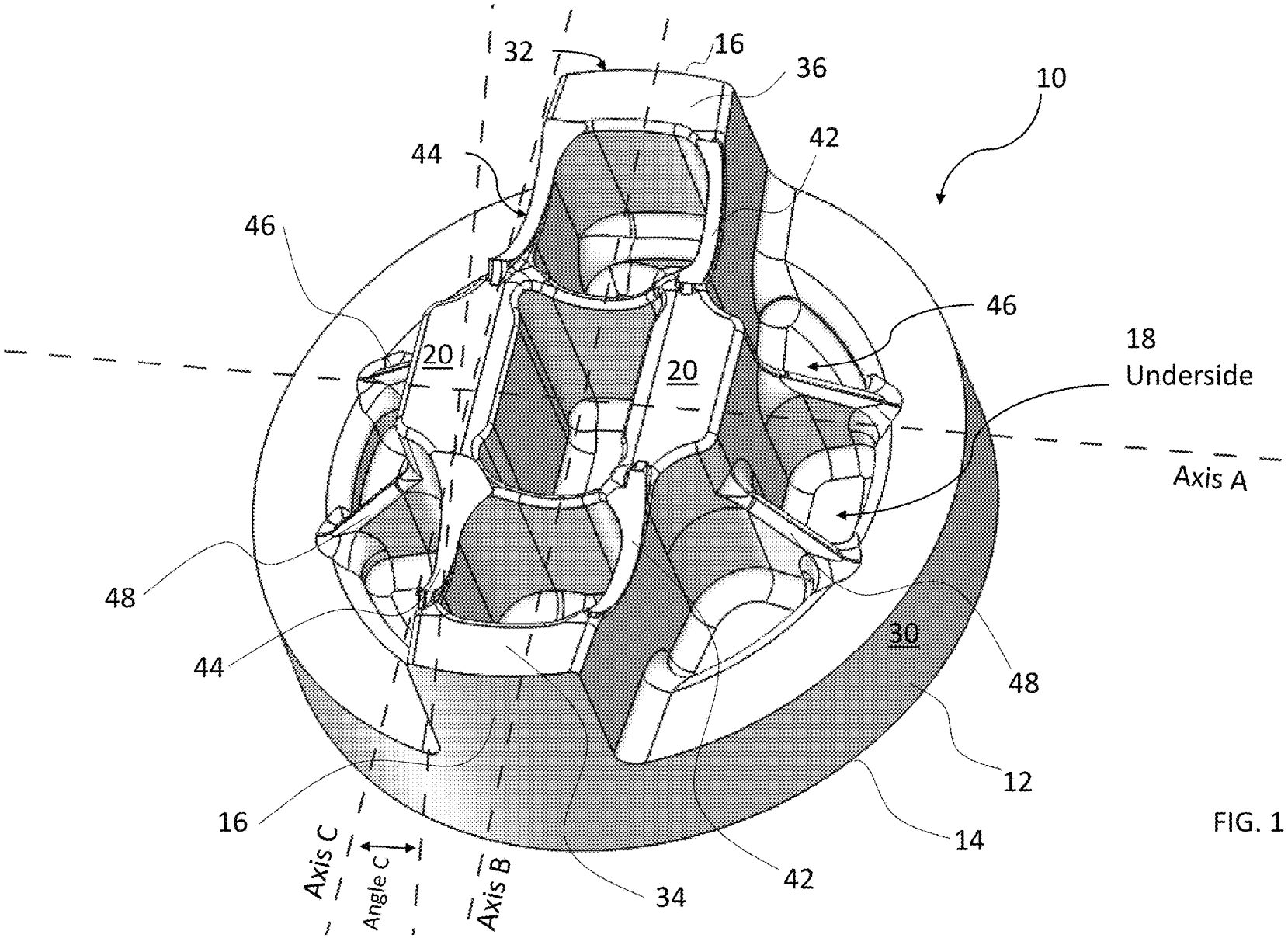
FIG. 1 illustrates a perspective view of a piston forging for use in an internal combustion engine in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention is directed towards an improved forged piston for use in an internal combustion engine, and that comprises a re-orientated and improved grain structure that is most beneficial to the resistance of combustion and inertial forces that are enacted upon a piston during its operation in an internal combustion engine. More specifically, the improved forged piston of the present invention is capable of withstanding relatively high levels of stress, and exhibits enhanced stiffness and resistance to loads. Additionally, the improved forged piston of the present invention has a reduced piston surface area, particularly on the radially outer surfaces, to reduce dynamic frictional forces, and is relatively light weight to improve the inertial response of the piston during operation.

Figure 2:
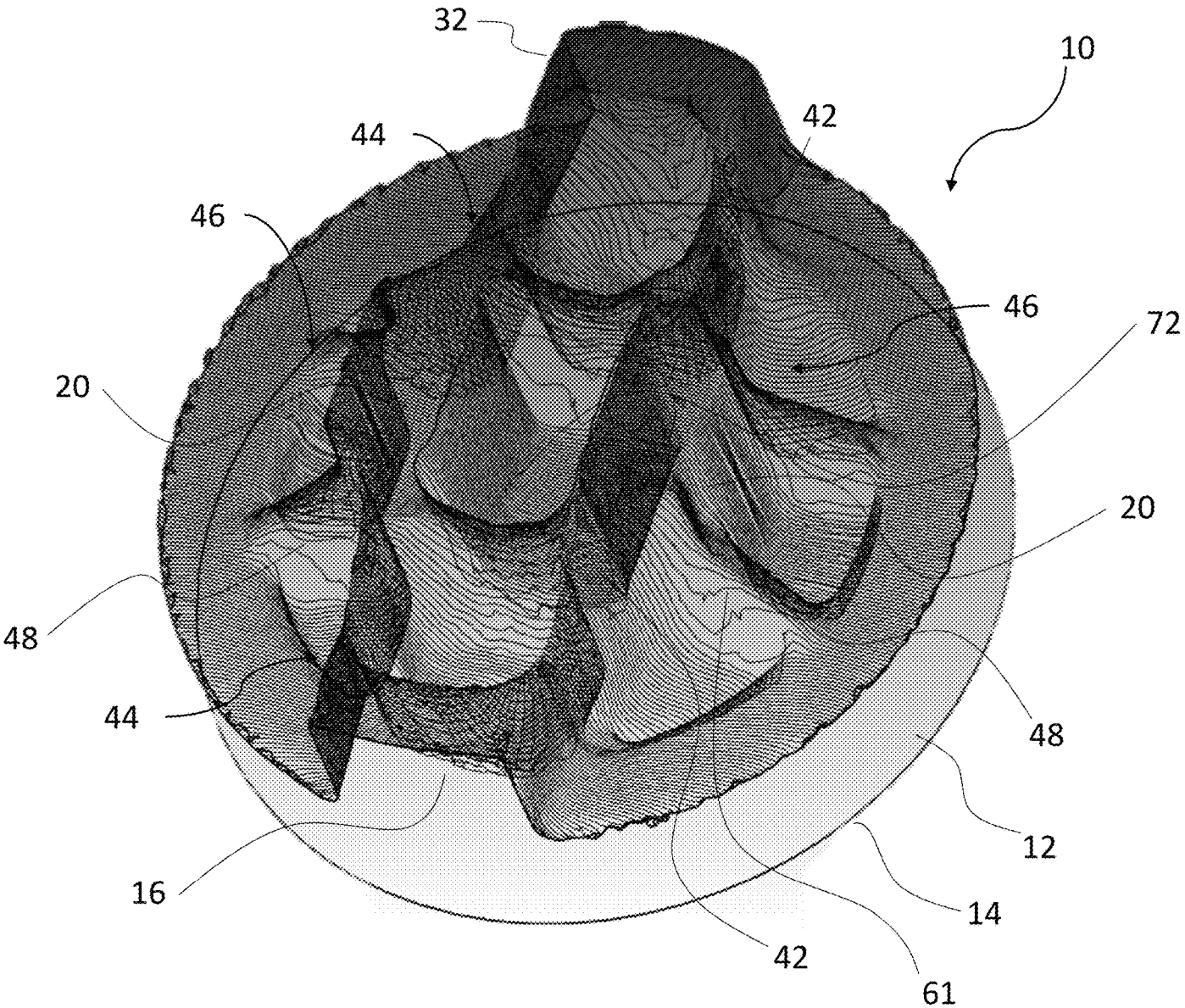
FIG. 2 illustrates a perspective view of the piston forging use in an internal combustion engine in accordance with the disclosed architecture.

Referring initially to the drawings, FIG. 1 illustrates a perspective view of a piston forging 10 for use in an internal combustion engine (not shown). Piston forging 10 preferably comprises a crown 12 and a skirt 16 extending generally axially away from the crown 12. More specifically, the skirt 16 extends generally downwardly and away from the crown 16. It should be noted that the piston forging 10 illustrated in FIGS. 1 and 2 is inverted from its configuration during use, and therefore, the "downwardly" and "upwardly" orientation referenced herein is opposite from the orientation illustrated in FIGS. 1 and 2.

The crown 12 preferably comprises a top surface 14 and an opposing underside 18. The top surface 14 can have any of a wide variety of configurations such as, but not limited to, a concave dish shape, a convex dome shape, a flat surface, or the like. Additionally, the top surface 14 may have a variety of reliefs formed therein as are well known in the art, but in many cases is generally flat.

The piston forging 10 may further comprise a pair of spaced apart pin towers 20 extending generally axially away from the crown 12, and approximately perpendicularly out of the underside 18 of the crown 12. More specifically, the pair of pin towers 20 are coupled to and extend generally downwardly or away from the crown 12. Each of the pair of pin towers 20 are joined to the underside 18 of the crown 12 by a fillet 72. The fillet 72 can be generally described as adding a radius or rounding of an interior corner of the pin tower 20 at its base. The piston forging 10 further comprises a plurality of grains 61 that flow generally across the piston forging 10 and are oriented to resist forces applied to the piston forging 10, as explained more fully below.

When the piston forging 10 is machined, each pin tower 20 will comprise a generally circular opening (not shown), such as a pin bore, formed therethrough to receive a pin, such as a piston wrist pin (not shown) therethrough. The generally circular openings of each pin tower 20 are aligned generally parallel along an axis A to accept the piston wrist pin as illustrated in FIG. 1. Axis A runs perpendicular or substantially perpendicular to an axis B that is positioned between the pair of opposed skirt panel portions 32, as best shown in FIG. 1.

In operation and during a power stroke of the piston, the pin towers 20 of improved forged piston 10 transmit the combustion forces and downward movement of the piston 10 to a connecting rod (not shown) and a crankshaft (also not shown). In addition, during both the compression and exhaust strokes, the pin towers 20 restrain the crown 12 from traveling upwardly toward a cylinder head (not shown). Accordingly, each pin tower 20 is typically a relatively stiff, robust and strong structure, and together, the pin towers 20 usually contribute to much of the overall mass of the piston 10.

The skirt 16 comprises a pair of opposed skirt panel portions 32, and a skirt band 30, as best shown in FIG. 1. The pair of opposed skirt panel portions 32 preferably comprise a first skirt panel portion 34, and a second skirt panel portion 36. The pair of opposed skirt panel portions 32 are spaced away from the crown 12, and the skirt band 30 extends generally around a perimeter of the piston forging 10, as best shown in FIG. 1. More specifically, the skirt band 30 connects the pair of opposed skirt panel portions 32 so that the first skirt panel portion 34 and the second skirt panel portion 36 are positioned approximately 180 degree from each other on opposite sides of the piston forging 10, as best shown in FIG. 1.

Additionally, each of the pair of opposed skirt panel portions 32 is designed to accommodate side loads during the operation of the improved forged piston 10, and to provide alignment for the piston 10 within a piston cylinder (not shown). Accordingly, each of the opposed skirt panel portions 32 may be generally solid masses and lack any opening therethrough. Further, each of the opposed skirt panel portions 32 may also be an area of increased thickness or strength, and may extend radially outward from the adjacent or underlying portions of the skirt 16, such as the skirt band 30.

Figure 3:
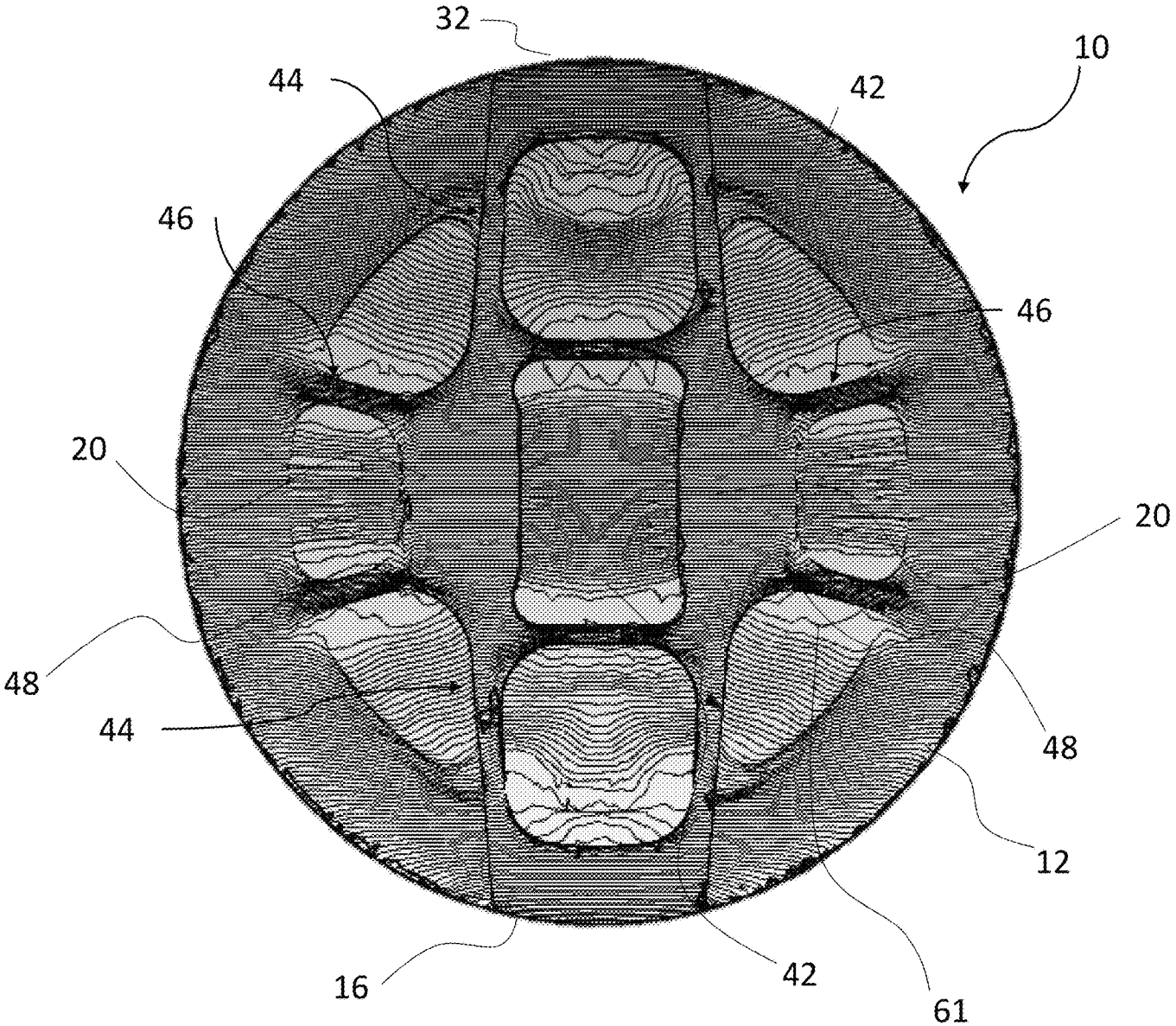
FIG. 3 illustrates an overhead view of the piston forging for use in an internal combustion engine in accordance with the disclosed architecture.

As best illustrated in FIGS. 1-3, each of the pair of opposed skirt panel portions 32 circumferentially extend for a total angle of approximately 60 degrees about the outer perimeter of the skirt 16, skirt band 30, and piston forging 10. However, this is not meant as a limitation, as each skirt panel portion 32 may extend other distances or angles to suit a particular application and/or user preference, such as between approximately 45 and 75 degrees, or between approximately 25 and 75 degrees, or whatever other angle that will sufficiently resist loading without adding excessive weight and/or frictional resistance to improved piston 10.

The improved piston forging 10 may further comprise a plurality of skirt panel strut assemblies 42, and each of the plurality of skirt panel strut assemblies 42 may further comprise a pair of skirt panel struts 44. More specifically, each of the skirt panel strut assemblies 42 extend radially between one of the opposed skirt panel portions 32 and one of the pin towers 20, positioned at or adjacent to the crown 12. As such, each pair of skirt panel struts 44 converge in a radially outward direction. Each pair of skirt panel struts 44 connects one of the pin towers 20 to the closest opposed skirt panel portion 32, extending from a radially outward end of the piston forging 10 or skirt panel portion 32 radially inward to a select one of the pin towers 20.

The pair of skirt panel struts 44 are essentially stiffening members or converging strut assemblies that converge in a radially outward direction. As best illustrated in FIG. 1, each or the converging skirt panel struts 44 may form an acute angle C ranging from between approximately 5-35 degrees from axis C, which is parallel to axis B. However, this is not meant as a limitation as the range of the acute angle may be wider or narrower to suit a particular application and/or user preference.

The improved forged piston 10 further comprises a plurality of supplemental strut assemblies 46. Each of the plurality of supplemental strut assemblies 46 extend generally radially between the skirt band 30 and one of the pin towers 20, and there is preferably one strut assembly 46 supporting each of pin towers 20, as best illustrated in FIG. 1, or a total of two strut assemblies 46 per improved forged piston 10. Notwithstanding, the same should not be construed as a limitation, as more or less strut assemblies 46 can be employed without affecting the overall scope of the invention.

As best illustrated in FIGS. 1-3, each of the plurality of supplemental strut assemblies 46 comprises a pair of supplemental struts 48 that diverge in a radially outward direction from the associated pin tower 20. However, it should be noted that a variety of configurations of the pairs of supplemental struts 48 may be utilized, including supplemental struts 48 that converge in a radially outward direction, that neither converge or diverge in a radially outward direction, or any combination thereof as desired.

The improved piston 10 may be manufactured by forging a stock material, such as aluminum or metal alloys, into the general shape of the finished part, which include the skirt 16, the pin towers 20, the plurality of skirt panel strut assemblies 42, and the plurality of supplemental strut assemblies 46. In one embodiment of the forging process, the material to be forged into the improved piston 10 will feature a grain structure that flows in a primary direction. The present invention comprises a piston forging 10 that re-orients this grain flow in a particular manner during the forging process in order to strengthen the piston forging 10 against combustion and inertial loadings.

More specifically, during the forging process a piston forging blank (not shown) may have a grain structure that is oriented to be running largely in a single direction where the grains are generally oriented parallel to each other in a pre-formation grain structure. When the piston forging blank is pressed during the forging operation, the grain structure is re-oriented into a new grain structure that follows the surface and the features of the piston forging 10 in a re-oriented grain structure. It is an object of the present invention to orient the grains 61 in a manner that is most beneficial to resist the combustion and inertial forces that are enacted on the machined piston during its operation in an internal combustion engine.

As best illustrated in FIGS. 2 and 3, the grains 61 (represented by flow lines) may flow generally from one side of the piston forging 10 to the opposing side. More specifically, the plurality of grains 61 are configured to flow from one side of the piston forging 10 to the opposing side generally along the axis A running between the pair of pin towers 20. Post forging, the plurality of grains 61 may flow directly across from one of the pin towers 20 to the other pin tower 20. The plurality of grains 61 flow along a length of the first pin tower 20 extending generally downward until reaching a base of the first pin tower 20.

As discussed supra, the base of each of the pin towers 20 are each joined to the crown 12 at the fillet 72 between each pin tower 20 and the crown 12. The plurality of grains 61 may then flow around a tangential perimeter of each fillet 72 rather than down each fillet 72 parallel to its axis. Thus, there is a grain flow wherein the plurality of grains 61 extend downwardly through one of the pin towers 20 and around its associated fillet 72, across the underside 18 of the crown 12, around the opposing fillet 72, and upwardly through the opposing pin tower 20.

Furthermore, the grain flow of the plurality of grains 61 is designed such that the flow also extends along a length of each pair of supplemental struts 48 generally parallel to the piston wrist pin axis A. This grain flow of the plurality of grains 61 along the length of each of the supplemental struts 48 may be concentrated at a surface of the piston forging 10 over all external surfaces of the supplemental struts 48. However, the grain flow of the plurality of grains 61 may also penetrate each of the plurality of supplemental struts 48 up to and including their entire thickness and length. Stated differently, the grain flow of the plurality of grains 61 may penetrate each of the plurality of supplemental struts 48 up to the entire depth of each supplemental strut 48, such that the entire thickness of each supplemental strut 48 comprises the grain flow running along its entire length.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A piston forging comprising:

a crown comprising a top surface and an underside;

a pair of pin towers extending axially away from the crown, wherein each of the pair of pin towers is joined to the underside of the crown by a fillet;

a skirt extending axially away from the crown and comprising a pair of opposed skirt panel portions and a skirt band; and a plurality of grains flowing across the piston forging and oriented to resist forces applied to the piston forging, wherein the plurality of grains flow around a tangential perimeter of each fillet.

2. The piston forging of claim 1 further comprising a plurality of skirt panel strut assemblies, each of skirt panel strut assembly extending radially between one of the pair of opposed skirt panel portions and one of the pair of pin towers.

3. The piston forging of claim 2, wherein each of the plurality of skirt panel strut assemblies comprise a pair of skirt panel struts.

4. The piston forging of claim 3, wherein each of the pair of skirt panel struts converge in a radially outward direction.

5. The piston forging of claim 1 further comprising a plurality of supplemental strut assemblies, each supplemental strut assembly extending radially between the skirt band and one of the pair of pin towers.

6. The piston forging of claim 5, wherein each of the plurality of supplemental strut assemblies comprise a pair of supplemental struts.

7. The piston forging of claim 6, wherein each of the pair of supplemental struts diverge in a radially outward direction.

8. The piston forging of claim 1, wherein the plurality of grains are configured to flow from one side of the piston forging to an opposing side of the piston forging along an axis running between the pair of pin towers.

9. A piston forging for use in an internal combustion engine, the piston forging comprising:

a crown comprising a top surface and an underside;

a pair of pin towers extending axially away from the crown;

a skirt extending axially away from the crown comprising a pair of opposed skirt panel portions and a skirt band extending around a perimeter of the piston forging connecting the pair of opposed skirt panel portions;

a plurality of skirt panel strut assemblies connecting the pair of opposed skirt panel portions to the pair of pin towers;

a plurality of supplemental strut assemblies each comprising a pair of supplemental struts extending radially between the skirt band and one of the pair of pin towers; and a plurality of grains flowing across the piston forging and oriented to resist forces applied to the piston forging, wherein an inner portion of the opposed skirt panel portions extend more radially outward from the adjacent skirt band than an inner surface of the skirt band.

10. The piston forging of claim 9, wherein each of the pair of opposed skirt panel portions extend circumferentially about an outer perimeter of the skirt band at a total angle of approximately 60 degrees.

11. The piston forging of claim 9, wherein each of the pair of pin towers is joined to the underside of the crown by a fillet.

12. The piston forging of claim 9, wherein the plurality of grains flow directly across from one of the pair of piston pin towers to the other of the pair of piston pin towers.

13. The piston forging of claim 9, wherein the plurality of grains extend along each of the supplemental struts generally parallel to a piston wrist pin axis.

14. The piston forging of claim 9, wherein the plurality of grains penetrates up to an entire thickness of each of the supplemental struts.

15. A piston forging for use in an internal combustion engine, the piston forging comprising:

a crown comprising a top surface and an underside;

a pair of pin towers extending out of the underside of the crown axially away from the crown, each of the pair of pin towers joined to the underside of the crown by a fillet;

a skirt extending axially away from the crown and comprising a pair of opposed skirt panel portions and a skirt band extending around a perimeter of the piston forging connecting the pair of opposed skirt panel portions;

a plurality of skirt panel strut assemblies connecting the pair of opposed skirt panel portions to the pair of pin towers;

a plurality of supplemental strut assemblies each comprising a pair of supplemental struts extending radially between the skirt band and one of the pair of pin towers; and a plurality of grains configured to flow from one side of the piston forging to an opposing side of the piston forging and oriented to resist forces applied to the piston forging, wherein the plurality of grains flow around a tangential perimeter of each fillet.

16. The piston forging of claim 15, wherein the plurality of grains flow downward through one of the pair of pin towers and around the fillet, across the underside of the crown, around the opposing fillet, and up the opposing pin tower.

17. The piston forging of claim 16, wherein the flow of the plurality of grains along each pair of supplemental struts is concentrated over an external surface of each supplemental strut.

18. The piston forging of claim 17, wherein the plurality of grains penetrates up to an entire thickness and length of each of the supplemental struts.

* * * * *